US007711286B2

(12) United States Patent
Oda et al.

(10) Patent No.: US 7,711,286 B2
(45) Date of Patent: May 4, 2010

(54) LEAKAGE PREVENTION MEMBER AND CLEANING DEVICE

(75) Inventors: Tomoyuki Oda, Kyoto (JP); Koji Murase, Hyogo (JP); Hiroyuki Ueda, Osaka (JP); Hidenori Takenaka, Osaka (JP); Nobuhiro Horiuchi, Nara (JP); Jumpei Hobo, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 615 days.

(21) Appl. No.: 11/716,597

(22) Filed: Mar. 12, 2007

(65) Prior Publication Data

US 2008/0101817 A1 May 1, 2008

(30) Foreign Application Priority Data

Oct. 26, 2006 (JP) ..... 2006-291704
Oct. 26, 2006 (JP) ..... 2006-291705

(51) Int. Cl.
*G03G 21/00* (2006.01)

(52) U.S. Cl. ..... 399/102; 399/350

(58) Field of Classification Search ..... 399/102, 399/350, 351

See application file for complete search history.

(56) References Cited

U.S. PATENT DOCUMENTS 6,553,195 B2 * 4/2003 Korfhage et al. ..... 399/102
6,744,999 B2 * 6/2004 Bloemen et al. ..... 399/102
7,539,438 B2 * 5/2009 van Leipsig et al. ..... 399/102

FOREIGN PATENT DOCUMENTS

JP 04-322273 A 11/1992
JP 05-224515 A 9/1993
JP 07-005794 A 1/1995

* cited by examiner

*Primary Examiner*—William J Royer
(74) *Attorney, Agent, or Firm*—Frommer Lawrence & Haug LLP

(57) ABSTRACT

A seal member 264 prevents leakage of developer to the side of a photosensitive drum 10 when cleaning the surface of the photosensitive drum 10 of a color printer 1, and has a contact portion 264*a* and a movement control portion 264*b*. The contact portion 264*a*, through which developer is unable to pass, is able to deform elastically in a direction, and to approach and to separate from the surface of the photosensitive drum 10, able to be in line contact with the surface of the photosensitive drum 10 such that developer is unable to pass between the surface of the photosensitive drum 10 and the contact portion 264*a*. The movement control portion 264*b* is connected to the contact portion 264*a*, and configured to control the movement of the seal member 264 with the rotation of the photosensitive drum 10 of the contact portion 264*a*.

16 Claims, 5 Drawing Sheets

LEAKAGE PREVENTION MEMBER AND CLEANING DEVICE

CROSS-REFERENCE TO RELATED APPLICATIONS

This application claims priority to Japanese Patent Application Nos. 2006-291704 and 2006-291705 both filed on Oct. 26, 2006. The entire disclosures of Japanese Patent Application Nos. 2006-291704 and 2006-291705 are hereby incorporated herein by reference.

BACKGROUND OF THE INVENTION

1. Field of the Invention

The present invention relates to a leakage prevention member that prevents the leakage of developer from the surface of rotation members such as the surface of an electrostatic latent image carrier, an intermediate transfer member, developing rollers of a developing device, or the like of an image forming device. The present invention also relates to a cleaning device that has the leakage prevention member.

2. Background Information

There has been an image forming device made of an image forming unit configured to form an image based on image information, a fixing unit configured to fix the image formed by the image forming unit onto a sheet of paper, and a discharging unit configured to discharge the sheet of paper with the image fixed thereon by the fixing unit. In this image forming device, an image is formed on a sheet of paper by the image forming unit based on the image information, and fixed by the fixing unit. Then, the sheet of paper with the image fixed thereon is discharged from the discharging unit.

Here, an existing image forming unit includes one that has an electrostatic latent image carrier on which an electrostatic latent image is formed on the surface thereof, a developing device that supplies developer to the electrostatic latent image carrier, and a cleaning unit that cleans the surface of the electrostatic latent image carrier. In this image forming unit, an electrostatic latent image is formed on the surface of the electrostatic latent image carrier based on the image information, and developer is supplied from the developing device to the electrostatic latent image carrier. Then, the image formed on the surface of the electrostatic latent image carrier is transferred onto a sheet of paper. Then, the cleaning unit cleans the electrostatic latent image carrier.

This kind of image forming device includes a plurality of rotation members that carry developer, and a seal member for preventing developer from leaking from the rotation member. For example, there is a cleaning device for the electrostatic latent image carrier that includes a blade member that scrapes off developer from the surface of the electrostatic latent image carrier that is able to carry an image formed by developer, a frame that stores developer scraped off by the blade member in the interior thereof, and a seal member arranged on the two edge portions of the blade member for preventing developer from leaking from the two edge portions of the blade member. Here, as disclosed in Japanese Patent Application Publication 7-5794, since there is a possibility that developer may leak out from between the electrostatic latent image carrier and the seal member when the positioning of the seal member and the blade member is not accurate, the positioning of the seal member is based on the blade member in order to position the seal member accurately.

In a conventional cleaning device, a seal member that is in contact with the electrostatic latent image carrier that is able to hold an image formed of developer is made of nonwoven fabric, and thus results in a tiny gap between the electrostatic latent image carrier and the seal member. Especially in the case with nonwoven fabric, it is difficult to form a shape of seal member that follows the surface of the electrostatic latent image carrier, and the sealing capability is inferior. As a result, when developer with fine particles or a liquid type developer or the like is used, developer may leak out from the gap.

Furthermore, in the above cited reference, the position of the seal member with respect to the blade member is precisely maintained. However, the positioning of the seal member with respect to the electrostatic latent image carrier that is able to hold an image formed of developer is not mentioned especially. Since the electrostatic latent image carrier is normally in a drum shape, the positioning of the seal member with respect to the electrostatic latent image carrier is also important. This is because if the position of the seal member with respect to the electrostatic latent image carrier is out of alignment, the entire surface of the seal member that is in contact with the drum surface will not be in contact uniformly, and it will become easy for a leakage to occur. In addition, when the electrostatic latent image carrier rotates, it is possible that the seal member may move in the rotation direction with the rotation of the electrostatic latent image carrier, and in this case, an excellent contact between the two will not be maintained.

In view of the above, it will be apparent to those skilled in the art from this disclosure that there exists a need for an improved leakage prevention member and cleaning device. This invention addresses this need in the art as well as other needs, which will become apparent to those skilled in the art from this disclosure.

SUMMARY OF THE INVENTION

An object of the present invention is to prevent the leakage of toner when developer with fine particles or a liquid type developer or the like is used, and control the movement of the seal member with the rotation of the rotation members such as the electrostatic latent image carrier.

A leakage prevention member according to a first aspect of the present invention is configured to prevent the leakage of developer from the side of a cleaning member arranged on a cleaning device configured to clean a rotation body when cleaning a surface of the rotation body of an image forming device. Further, the leakage prevention member includes a contact portion and a movement control portion. The contact portion being impermeable relative to developer or through which developer is unable to pass, and is able to be deformed elastically in a direction to approach and to separate from the surface of the rotation body, and able to contact the surface of the rotation body such that developer is not able to pass between the surface of the rotation body and the contact portion. The movement control portion is connected to the contact portion, and configured to control the movement of the contact portion from a state in which the contact portion contacts the rotation body.

In the leakage prevention member, when cleaning the surface of the rotation body, the contact portion contacts with the surface of the rotation body such that developer will not be able to pass between the surface of the rotation body and the contact portion. Here, it is possible to prevent the leakage of developer from the side of the cleaning member that cleans the rotation body, even in a case in which developer with fine particles or a liquid type developer or the like is used because developer will not be able to pass between the surface of the rotation body and the contact portion.

A leakage prevention member according to a second aspect of the present invention is configured to prevent the leakage of developer from the side of a cleaning member arranged on a cleaning device that cleans a rotation body when cleaning the surface of the rotation body of an image forming device, and the leakage prevention member includes a contact portion and a movement control portion. The contact portion is able to be deformed elastically in a direction to approach and separate from the surface of the rotation body, and has a first contact portion that is able to be in line contact along the surface of the rotation body such that developer is unable to pass between the surface of the rotation body and the contact portion. The movement control portion is connected to the contact portion and configured to control the movement of the contact portion from a state in which the contact portion contacts the rotation body. In this disclosure, line contact refers to a condition in which one member contacts a second member such that one member is shaped or is deformed to adhere substantially or exactly to the shape of the second member where contact is made. In other words, one member line contacts with another when the one member has the same or substantially the same shape of the other over an area of contact such that the area of contact is void of gaps.

In the leakage prevention member, when cleaning the surface of the rotation body, the contact portion is in line contact with the surface of the rotation body such that developer is not able to pass through between the surface of the rotation body and the contact portion. Here, since the first contact portion is able to be in line contact with the surface of the rotation body, the contact area is less than that of a surface contact, and pressure added to the rotation body from the portion that is in contact will become higher. Therefore, it will become difficult for developer to leak out.

A leakage prevention member according to a third aspect of the present invention is the leakage prevention member of the second aspect, wherein the contact portion further includes a second contact portion in addition to the first contact portion. The second contact portion is able to be in line contact along the surface of the rotation body and arranged to be parallel with the first contact portion on the outer side, i.e. a side nearest the edge of the electrostatic latent image carrier, in the axis direction of the rotation body. Here, with the second contact portion, it is possible to prevent further developer from leaking out. In addition, compared to a case in which the entire contact portion is in contact, the area on which the friction force acts becomes smaller.

A leakage prevention member according to a fourth aspect of the present invention is the leakage prevention member of the second aspect, wherein the movement control portion is formed to be integral with the contact portion. Here, it will become easy to manufacture the leakage prevention member.

A leakage prevention member according to a fifth aspect of the present invention is the leakage prevention member of the second aspect, wherein the surface on the side of the electrostatic latent image carrier of the contact portion has the same curvature as the electrostatic latent image carrier. Here, it is possible to prevent a gap between the contact portion and the electrostatic latent image carrier.

A leakage prevention member according to a sixth aspect of the present invention is the leakage prevention member of the second aspect, wherein a valley is formed in the contact portion that extends in the direction that intersects with the axis direction of the rotation body, on the surface that is on the opposite side of the surface that is able to be in contact with the surface of the rotation body, and the contact portion is able to be transformed elastically in the axis direction, i.e., the direction of the axis of rotation, of the rotation body. Here, it becomes easy to be transformed elastically in the direction that the rotation body extends.

A cleaning device according to a seventh aspect of the present invention is configured to clean the surface of a rotation body of an image forming device. The cleaning device has a frame, a blade member, and a leakage prevention member. The frame is arranged in the vicinity of the rotation body. The blade member is in the form of a plate, extending along the axis direction of the rotation body, and arranged in the frame with the front edge thereof in contact with the surface of the rotation body. The leakage prevention member is the leakage prevention member that is arranged on the two sides of the blade member.

In this cleaning device, when cleaning the rotation body, the portion of the blade member that is in contact with the rotation body scrapes off developer remaining on the surface of the rotation body. At this time, when the residue developer moves outward in the extending direction of the rotation body from the two ends of the blade member, the leakage prevention member prevents the developer from flowing out, and the leakage of developer is prevented. Here, it is possible to lower the chance of the leakage of developer when a liquid type developer is used.

A cleaning device according to an eighth aspect of the present invention is the cleaning device of the seventh aspect, wherein the leakage prevention member is arranged between the blade member and the frame in an elastically deformed state, and in surface contact with the blade member and the frame. Here, the leakage prevention member attempts to break free from the elastic deformation, and thus, lowers the chances that a gap is formed between the leakage prevention member and the frame and the blade member. Thus, it becomes easy to prevent the leakage of developer.

A cleaning device according to a ninth aspect of the present invention is the cleaning device of the seventh aspect. The cleaning device further includes a bias mechanism configured to bias the leakage prevention member to the side of the rotation body. Here, since the leakage prevention member is biased to the rotation body, it is even easier to prevent the leakage of developer.

A leakage prevention member according to a tenth aspect of the present invention is the leakage prevention member of the fourth aspect, wherein a movement control portion controls the movement of the contact portion and the contact portion controls the movement with the rotation of the rotation body.

In this leakage prevention member, when the residue toner on the surface of the rotation body is being cleaned by the cleaning device, the contact portion is in contact with the surface of the rotation body in a way that developer is unable to pass between the surface of the rotation body and the contact portion. The movement control portion that is formed integral with the contact portion controls the movement of the contact portion, which occurs with the rotation of rotation body. Here, it is possible to control the movement of the leakage prevention member, with the rotation of the rotation body.

A leakage prevention member according to an eleventh aspect of the present invention is the leakage prevention member of the tenth aspect, wherein the movement control portion has an engagement member that is configured to engage with the frame of the cleaning device. Here, it is possible to control the movement of the contact portion by the engagement of the engagement member with the frame.

A leakage prevention member according to a twelfth aspect of the present invention is the leakage prevention member of the eleventh aspect, wherein the engagement member of the movement control portion is a protrusion that engages with an insertion hole that is formed in the frame. Here, movement is controlled by the protrusion engaging with the insertion hole. Here, the insertion hole can be a concave portion, or it can be a through-hole.

A leakage prevention member according to a thirteenth aspect of the present invention is the leakage prevention member of the twelfth aspect, wherein the insertion hole is a cavity in a circular form, and the protrusion is a cylindrical portion having a radius that is smaller than the insertion hole. Here, it becomes easy for the protrusion to engage with the insertion hole.

A leakage prevention member according to a fourteenth aspect of the present invention is the leakage prevention member of the second aspect, wherein at least the contact portion is coated by a fluorine system. Here, the oil-repellent property of the contact portion becomes higher.

A leakage prevention member according to a fifteenth aspect of the present invention is the leakage prevention member of the tenth aspect, wherein the contact portion and the movement control portion are a cast. Here, it becomes easy to manufacture the leakage prevention member.

A cleaning device according to a sixteenth aspect of the present invention is a cleaning device configured to clean the surface of a rotation body of an image forming device. The cleaning device has a frame, a blade member, and a leakage prevention member. The frame is arranged in the vicinity of the rotation body. The blade member is in the form of a plate, extending along the axis direction of the rotation body, and is fixed to the frame with the front edge thereof in contact with the surface of the rotation body. The leakage prevention member is arranged on the two sides of the blade member.

In this cleaning device, developer on the rotation body is scraped off by the blade member. During this time, the leakage prevention member is able to prevent developer from leaking from the outside in the axis direction of the blade member. Here, it is possible to control the movement of the seal member, with the rotation of the rotation body.

In the present invention, it is possible to prevent the leakage of developer in the case that developer with fine particles or a liquid type developer or the like is used. In addition, it is possible to control the movement of the seal member, with the rotation of the electrostatic latent image carrier.

These and other objects, features, aspects, and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure.

DETAILED DESCRIPTION OF THE PREFERRED EMBODIMENTS

Figure 1:
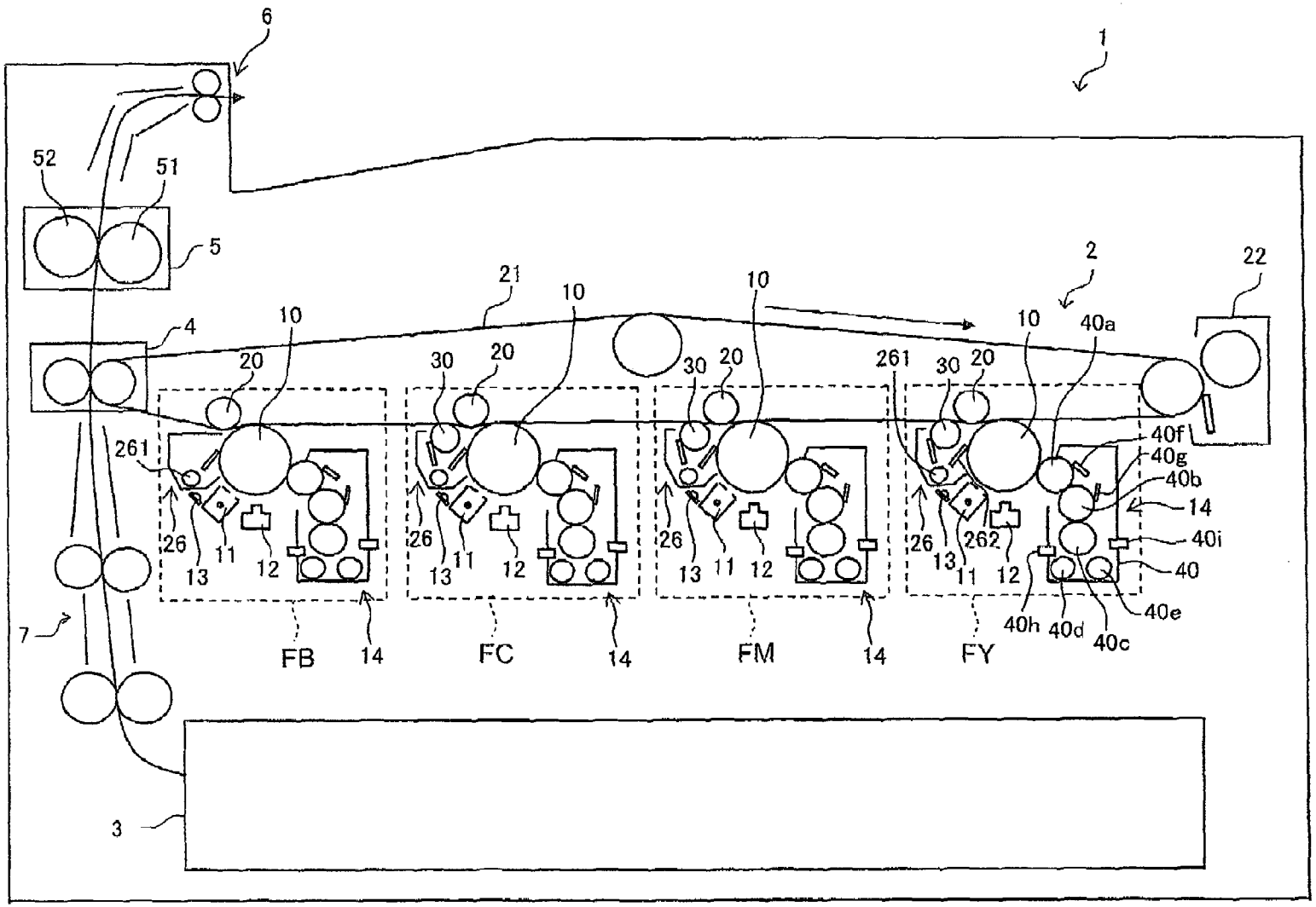
FIG. 1 is a cross-sectional view of an entire color printer according to a preferred embodiment of the present invention.

Selected embodiments of the present invention will now be explained with reference to the drawings. It will be apparent to those skilled in the art from this disclosure that the following descriptions of the embodiments of the present invention are provided for illustration only and not for the purpose of limiting the invention as defined by the appended claims and their equivalents.

One embodiment of an image processing device in accordance with the present embodiment will be described below based on the drawings. Furthermore, for the convenience of explanation, certain positions and sizes and the like of components drawn in the drawings are being emphasized. In addition, the present invention is not limited to the embodiment below, in which a printer is described as an example of an image processing device of the present invention. More specifically, as long as the image processing device of the present invention has an image forming unit, the image processing device can be a copying machine, a so-called multi-function device (MFP, Multi Function Peripheral) having a facsimile function and a copying function, a device having only a copying function, and the like. Appropriate changes can be made on the specific configurations of the components thereof described below and other components and the like.

1. Overall Configuration

The configuration of a color printer 1 as an image forming device in accordance with a preferred embodiment of the present invention will be described briefly using FIG. 1. FIG. 1 is a front cross-sectional view that shows the configuration of the main portions of the color printer 1.

The color printer 1 mainly includes a tandem type image forming unit 2, a sheet storage unit 3, a second transfer unit 4, a fixing unit 5, a discharging unit 6, and a sheet conveyance unit 7. The tandem type image forming unit 2 is configured to form a toner image based on image data. The sheet storage unit 3 is configured to store sheets. The second transfer unit 4 is configured to transfer the toner image formed at the image forming unit 2 onto a sheet. The fixing unit 5 is configured to fix the transferred toner image on the sheet. The discharging unit 6 is configured to discharge the sheet after the image is fixed on the sheet. The sheet conveyance unit 7 is configured to convey the sheet from the sheet storage unit 3 to the discharging unit 6.

The image forming unit 2 has an intermediate transfer belt 21, a cleaning unit 22 to clean the intermediate transfer belt 21, and image forming units FY, FM, FC, and FB that correspond to yellow (Y), magenta (M), cyan (C), black (Bk) respectively.

The intermediate transfer belt 21 has conductive properties and has a usable width in the direction perpendicular to the sheet conveying direction that is wider than a maximum size sheet of paper. The intermediate transfer belt 21 is without an end, in other words, it is formed as a loop-shaped belt and is a belt member that is looped, and driven to rotate in the clockwise direction as indicated by an arrow shown in FIG. 1. In the rotational drive, the side that faces the exterior will hereinafter be referred to as the outer surface, and the other side will be referred to as the inner surface.

The image forming units FY, FM, FC, and FB are arranged to be lined up near the intermediate transfer belt 21, between the cleaning unit 22 of the intermediate transfer belt 21 and the second transfer unit 4. In addition, the order of arrangement of each of the image forming units FY, FM, FC, and FB is not limited to this arrangement. However, considering the effect on the image that is completed by mixing a color portion with each of the colors, this arrangement is preferable. Each of the image forming units FY, FM, and FC has a photosensitive drum (electrostatic latent image carrier or rotation body) 10, an electrostatic charger 11, an LED exposure device 12, a developing device 14, a first transfer roller 20, a cleaning device 26, a neutralization device 13, and a carrier liquid removal roller 30. In addition, in these image forming units, the image forming unit FB is arranged in a position that is nearest to the second transfer unit 4, and does not include a carrier liquid removal roller 30, but the rest of the configuration thereof is preferably the same as the other image forming units. In addition, the cleaning device 26 will be described in detail later.

The photosensitive drum 10 is a cylindrical member, and able to carry on the surface thereof toner images having toner that is charged (plus polarity charge in this embodiment). The photosensitive drum 10 is able to rotate in the counterclockwise direction as shown in FIG. 1.

The electrostatic charger 11 is a device that is able to charge uniformly the surface of the photosensitive drum 10.

The LED exposure device 12 has a LED light source, and is able to form an electrostatic latent image on the surface of the photosensitive drum 10 by irradiating light on the surface of the photosensitive drum 10 that is charged according to image data.

Each developing device 14 is able to develop the electrostatic latent image into a toner image by providing the electrostatic latent image with toner, by keeping developer containing toner and liquid carrier (hereinafter may be referred to as carrier liquid as well) opposite the electrostatic latent image. In addition, the developing device 14 has a developer container 40, a developing roller 40*a*, a supply roller 40*b*, a drawing roller 40*c*, mixing spirals 40*d* and 40*e*, a developer cleaning blade 40*f*, and a supply roller doctor blade 40*g*.

The developer container 40 stores developer made of liquid carrier and toner particles in the interior thereof. The mixing spirals 40*d* and 40*e* are arranged to be entirely soaked in the developer in the developer container 40, and configured to mix the developer. The rotation of the mixing spirals 40*d* and 40*e* distributes the toner particles evenly in the carrier liquid.

The drawing roller 40*c* is arranged to be partially soaked in the developer in the developer container 40, able to rotate in the clockwise direction as shown in FIG. 1, and draws developer by attaching developer onto the surface thereof. As shown in FIG. 1, the supply roller 40*b* is arranged to be in contact with the drawing roller 40*c*, able to rotate in the counterclockwise direction, and receives the supply of developer from the drawing roller 40*c*. The supply roller doctor blade 40*g* is arranged in the vicinity of the downstream side in the rotation direction of the position in which the supply roller 40*b* and the drawing roller 40*c* are in contact, and controls the layer thickness of the developer on the surface of the supply roller 40*b*. The supply roller doctor blade 40*g* controls the developer layer thickness on the surface of the supply roller 40*b* to be a predetermined amount. The developing roller 40*a* is arranged to be in contact with the supply roller 40*b*, and able to rotate in the clockwise direction as shown in FIG. 1, with developer being supplied to the surface thereof from the supply roller 40*b*. Since the developer layer thickness on the supply roller 40*b* is being controlled to be a predetermined value, the developer layer thickness formed on the surface of the developing roller 40*a* is also maintained at a predetermined value. The developing roller 40*a* is in contact with the photosensitive drum 10. On the surface of the photosensitive drum 10, a toner image is formed (developing operation) according to the requested image data, by the difference between the electrical potential of the electrostatic latent image on the surface of the photosensitive drum 10 and the electrical potential of the developing bias applied to the developing roller 40*a*.

The developer on the surface of the developing roller 40*a* passes through the position where the developing roller 40*a* contacts the photosensitive drum 10 and is removed by the developer cleaning blade 40*f*. Developer will flow along the surface of the developer cleaning blade 40*f*, across a passage not shown in the figure, to mix with the developer stored in the developer container 40.

In addition, a toner concentration sensor 40*h* is arranged in the developer container 40, and configured to detect the toner concentration of the developer in the developer container 40. In the case that the detected toner concentration is lower than a predetermined value, toner (developer with a toner concentration higher than the predetermined value) will be supplied to the developer container 40 from a toner cartridge that is not shown in the figure. In the case that the toner concentration is higher than the predetermined value, carrier liquid will be supplied to the developer container 40 from a carrier liquid cartridge that is not shown in the figure.

Furthermore, a developer fluid level sensor 40*i* is arranged in the developer container 40, and configured to detect whether or not the fluid level of the developer inside the developer container 40 is a predetermined value. When it is detected that the fluid level of the developer is lower than the predetermined value, toner from a toner cartridge passing a pipe not shown in the figure, and carrier liquid from a carrier liquid cartridge passing a pipe not shown in the figure will each be supplied to the developer container 40, in predetermined proportions to adjust the fluid level to be a predetermined value. In addition, a developer adjustment device may be arranged, and toner and carrier liquid may be supplied to the developer container 40 after being mixed in predetermined proportions by the developer adjustment device. When it is detected that the fluid level of the developer is higher than the predetermined value, developer will be discharged from a developer discharging pipe not shown in the figure that is arranged in the developer container 40, and temporarily stored in a reserve tank and the like that is not shown in the figure.

The first transfer roller 20 is arranged to be in contact with the inner side of the intermediate transfer belt 21 between the photosensitive drum 10 and the carrier liquid removal roller 30. A voltage that is the reverse polarity (that is minus in this embodiment) of the charging polarity of the toner of the toner image formed on the surface of the photosensitive drum 10 is applied to the first transfer roller 20 from a power source that is not shown in the figure. That is, the first transfer roller 20 applies a voltage that is the reverse polarity of the charging polarity of the toner to the intermediate transfer belt 21 at the position in which the first transfer roller 20 is in contact with the intermediate transfer belt 21. Since the intermediate transfer belt 21 has conductive properties, by applying this voltage loner will be attracted to the outer side surface of the intermediate transfer belt 21 and the vicinity thereof.

The neutralization device 13 has a light source, and is configured to remove electricity from the surface of the photosensitive drum 10 by the light from the light source after developer is removed by a cleaning blade 262 that will be described later, and to prepare for the next image formation.

The carrier liquid removal roller 30 is an approximately cylindrical member that is able to rotate in the same direction as the photosensitive drum 10 around a rotation axis that is parallel to the rotation axis of the photosensitive drum 10 as the rotational center thereof. In addition, in case that the carrier liquid removal roller 30 is seen from the contact position between the photosensitive drum 10 and the intermediate transfer belt 21, the carrier liquid removal roller 30 is arranged to be in contact with the intermediate transfer belt 21 on the side more towards the side of the second transfer unit 4. The carrier liquid removal roller 30 is configured to remove carrier from the surface of the intermediate transfer belt 21.

The sheet storage unit 3 is arranged on the lower portion of the color printer 1, and stores sheets on which toner images will be fixed thereon. In addition, the sheet storage unit 3 has a paper cassette that stores sheets.

The second transfer unit 4 is configured to transfer toner images formed on the intermediate transfer belt 21 onto sheets, and has a support roller that supports the intermediate transfer belt 21, and a second transfer roller that is arranged opposite the support roller.

The fixing unit 5 is configured to fix toner images onto sheets, and is arranged above the second transfer unit 4. In addition, the fixing unit 5 has a heating roller 51 that is in contact with the toner image transferred onto the sheet, and a pressure roller 52 arranged opposite the heating roller 51.

The discharging unit 6 is configured to discharge sheets having toner images fixed thereon by the fixing unit 5, and is arranged on the upper portion of the color printer 1.

The sheet conveyance unit 7 is configured to convey sheets from the sheet storage unit 3 to the second transfer unit 4, fixing unit 5, discharging unit 6 and the like.

2. Cleaning Device

Next, the cleaning device 26 will be described.

Figure 2:
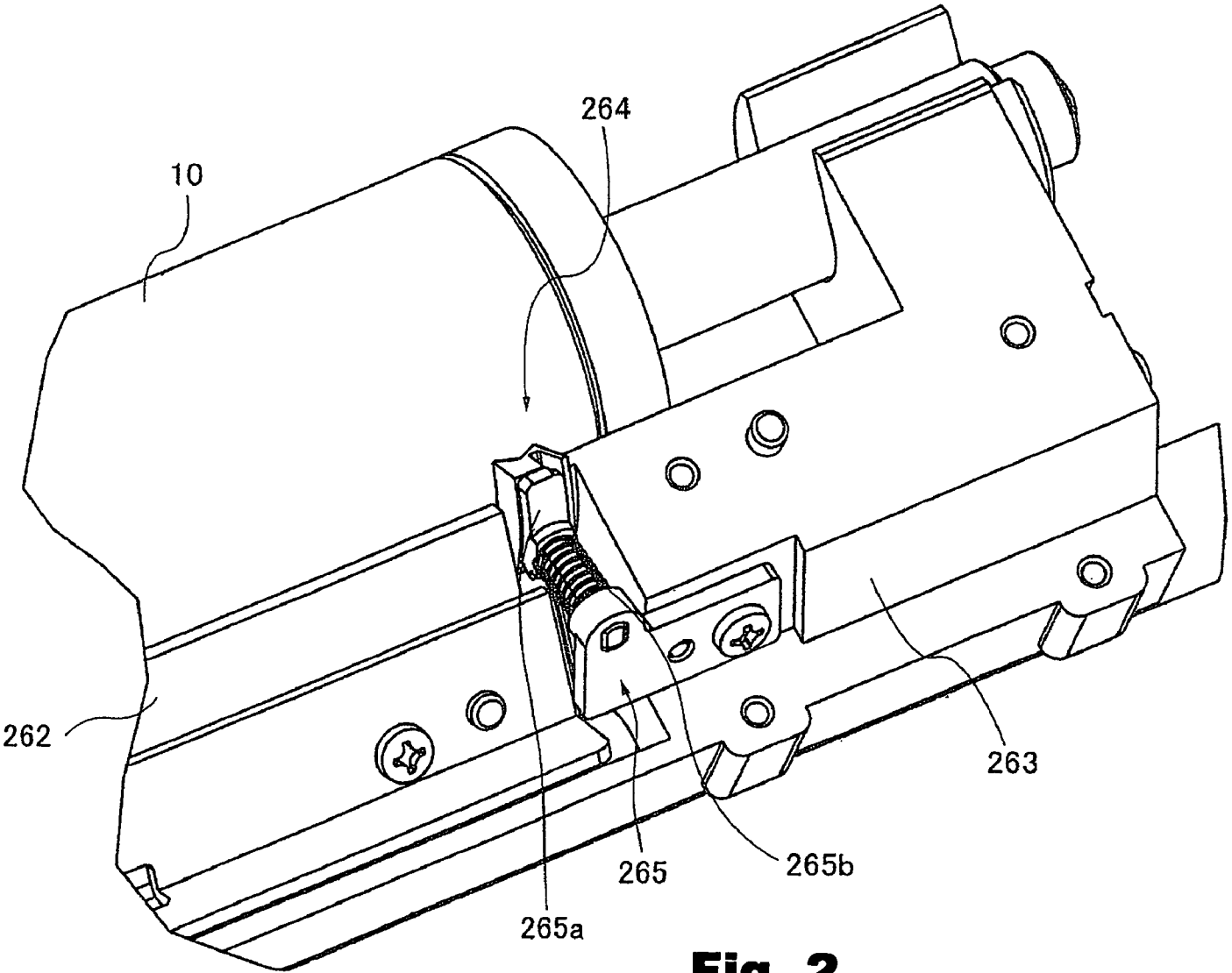
FIG. 2 is a perspective view of a photosensitive drum, a cleaning blade, and a seal member of the color printer.
Figure 3:
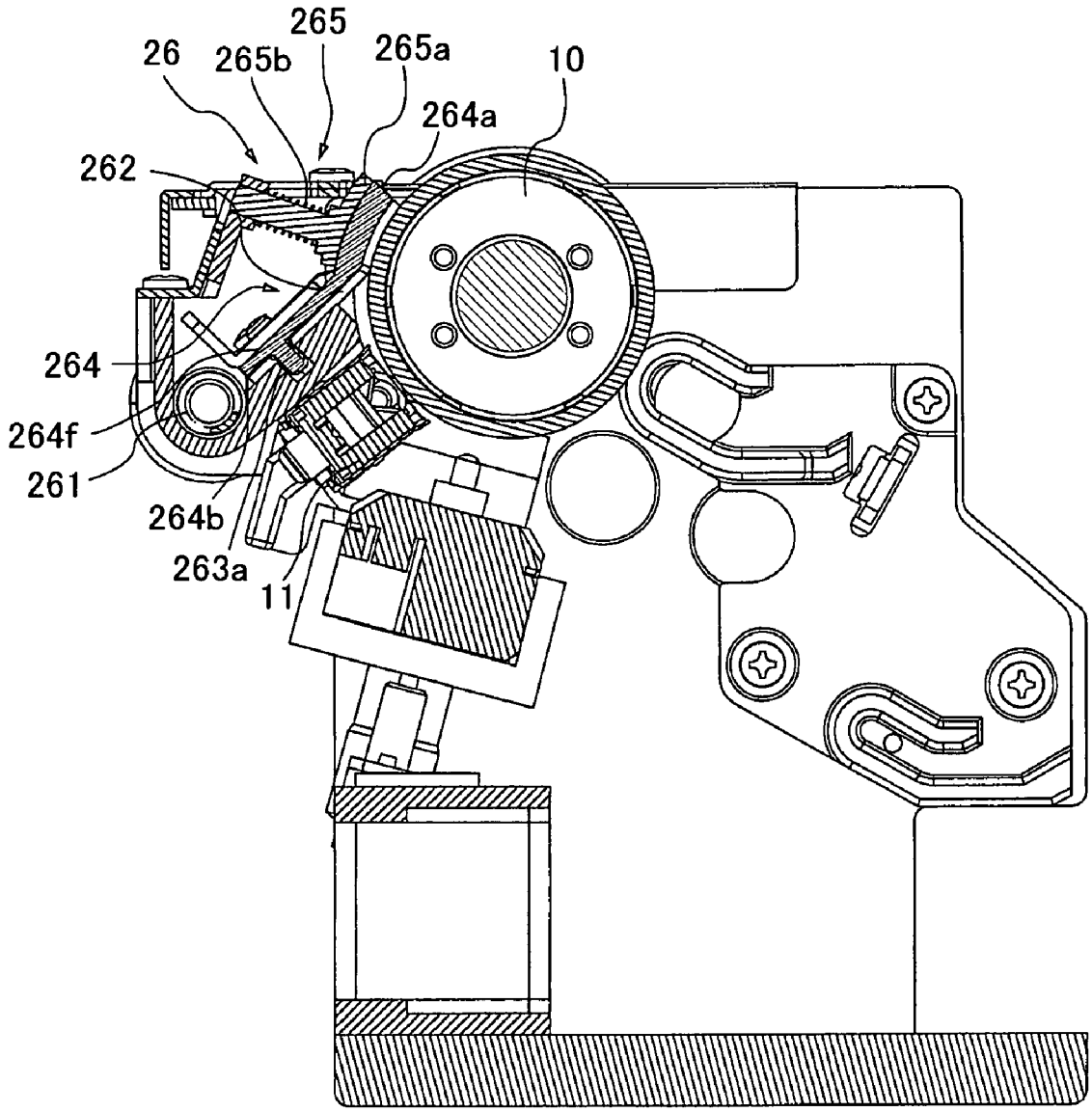
FIG. 3 is a cross-sectional view of a cleaning device of the color printer.
Figure 4:
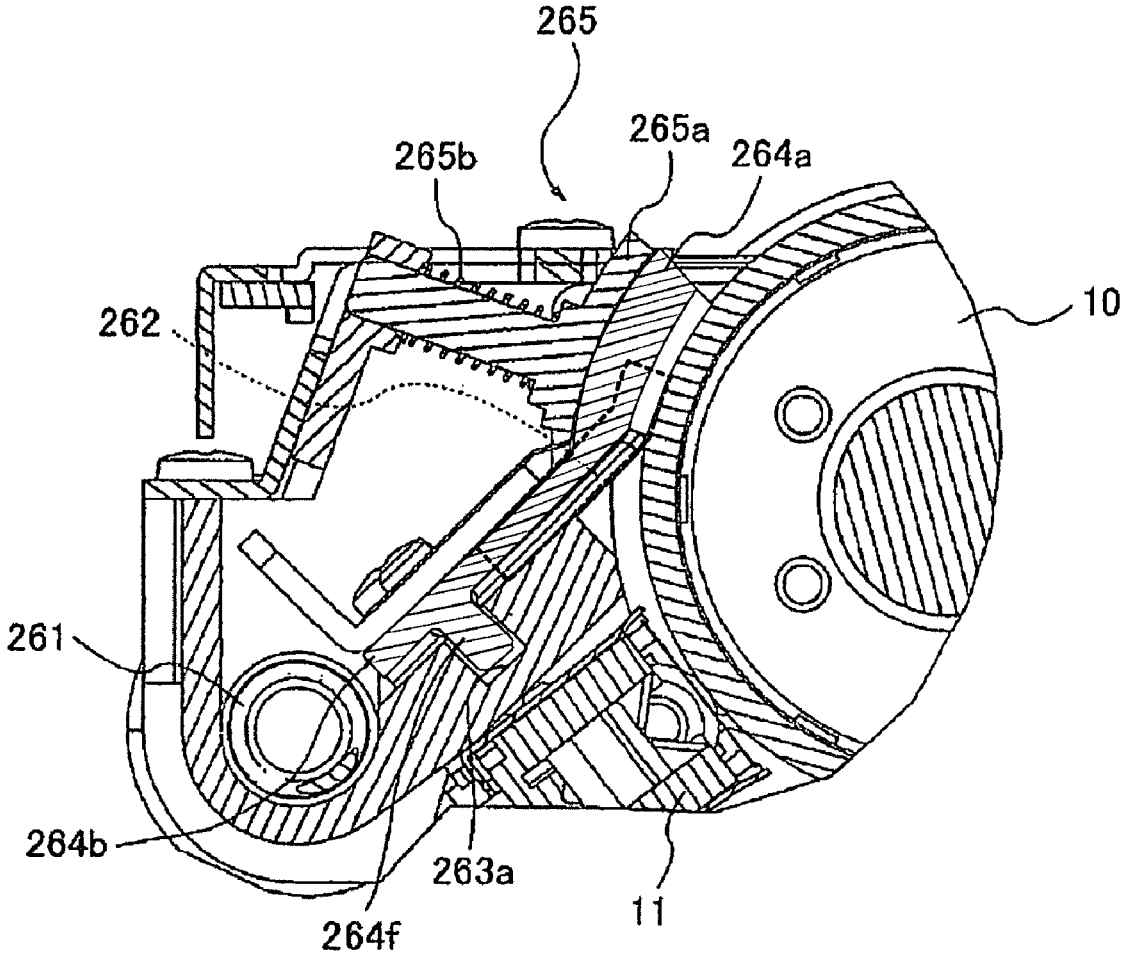
FIG. 4 is an enlarged view of a portion of the cleaning device in FIG. 3.

The cleaning device 26, as shown in FIGS. 2 to 4, is configured to clean developer (including toner and carrier liquid) left on the photosensitive drum 10 that is not transferred onto a sheet. The cleaning unit 26 is made of a residue developer conveying screw 261, a cleaning blade 262, a frame 263 having a case, a seal member 264 (leakage prevention member), and a bias mechanism 265. In addition, the cleaning device 26 is arranged lateral to and in the vicinity of the photosensitive drum 10. Here, FIG. 2 shows the cleaning blade 262 and the seal member 264, and FIG. 3 shows a section of the cleaning device 26. Although only one end is shown in FIG. 2, it should be apparent from this disclosure that the arrangement of the components are similarly configured and arranged on the opposite side of the cleaning blade 262. The other end is preferably a mirror image of the components shown in FIG. 2.

The residue developer conveying screw 261 is a screw shape member that is configured to convey residue developer inside the frame 263 to the outside. In addition, the residue developer conveying screw 261 is arranged on the bottom portion of the cleaning device 26.

The cleaning blade 262 is a plate member arranged parallel to the rotational axis of the photosensitive drum 10, and the front edge thereof is in contact with the photosensitive drum 10. In addition, the cleaning blade 262 is fixed to the frame 263. The cleaning blade 262 is configured to scratch residue developer from the photosensitive drum 10 and collect residue developer inside the frame 263.

The frame 263 has a portion in the interior thereof that stores developer removed from the photosensitive drum 10 by the cleaning blade 262. In addition, the frame 263 supports the rotational axis of the photosensitive drum 10. In addition, a concave portion 263*a* of a circular form is arranged in the frame 263 and configured to control the movement of the seal member 264 in the frame 263.

Figure 5:
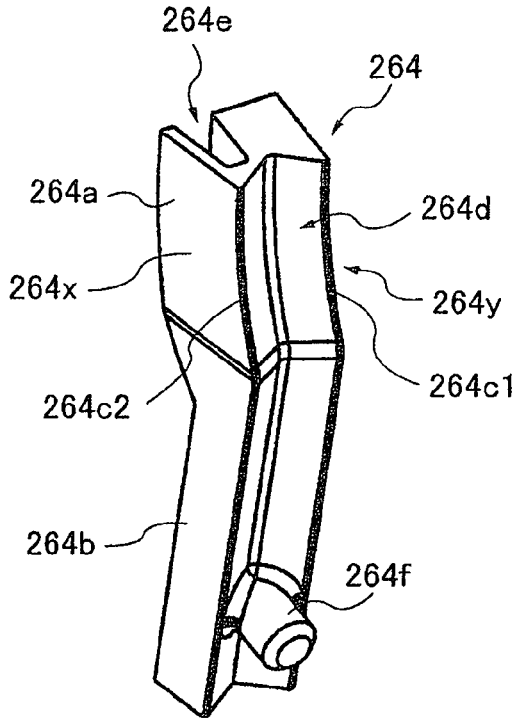
FIG. 5 is a perspective view of the seal member, looking from the side of the photosensitive drum.
Figure 6:
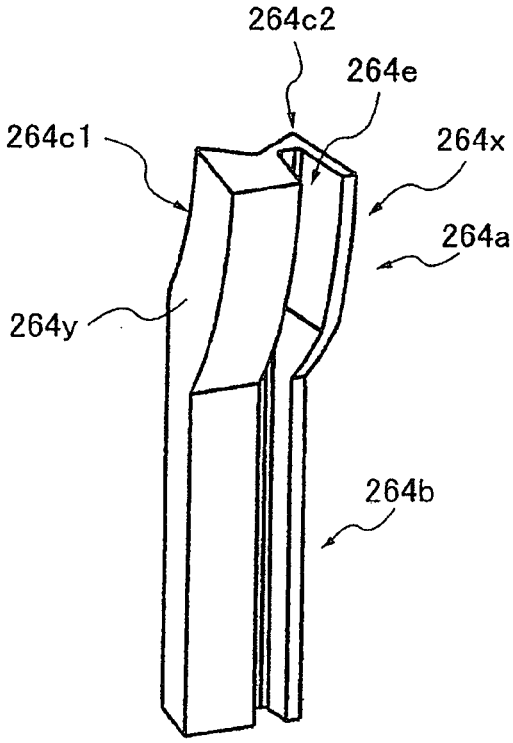
FIG. 6 is a perspective view of the seal member in FIG. 5 from the opposite side.

The seal member 264, as shown in FIG. 2, is arranged in contact with both ends of the cleaning blade 262 in the longitudinal direction which are situated near the two ends of the photosensitive dram 10 in its axial direction, to be more specific. The seal member 264 is configured to prevent developer from leaking from the cleaning blade 262 side when the surface of the photosensitive drum 10 is being cleaned. In addition, the seal member 264 is a plastic molding formed by urethane rubber, and made of a contact portion 264*a* and a movement control portion 264*b* as shown in FIGS. 5 and 6. Furthermore, the seal member 264 is arranged between the frame 263 and the cleaning blade 262 in an elastically deformed state. It should be apparent from this disclosure that the seal member 264 arranged on the opposite side can be a mirror image of the one shown in FIG. 2.

The contact portion 264*a* is in contact with the photosensitive drum 10 in a way that developer cannot pass through between the two. More specifically, the surface of the contact portion 264*a* on the side of the photosensitive drum 10 has a first contact portion 264*c*1 on the side of the cleaning blade 262 and a second contact portion 264*c*2 on the side of the frame 263 (collectively the first contact portion 264*c*1 and the second contact portion 264*c*2 may be called simply a contact portion 264*c*). Both the first contact portion 264*c*1 and the second contact portion 264*c*2 have a shape that follows the surface of the photosensitive drum 10, or they have the same curvature as the surface of the photosensitive drum 10 in a way such that gaps are not formed between them. By having the tips of the two contact portions 264*c* in contact with the photosensitive drum 10 in a state of line contact, the contact area between the photosensitive drum 10 and the seal member 264 is narrow, and therefore, even if a resin member such as rubber and the like having a large coefficient of friction is used as the seal member 264, it is possible to prevent the problem of irregular rotation of the rotational drive of the photosensitive drum 10. In addition, by arranging the second contact portion 264*c*2 on the outer side in the axis direction of the photosensitive drum 10 of the first contact portion 264*c*1 on the side of the cleaning blade 262, two contact portions 264*c* will be in contact the photosensitive drum 10, and thus, effectively prevent developer (including toner and carrier liquid) from passing through the seal member 264. In addition, by further having the linear tip of the second contact portion 264*c*2 to be in contact with the photosensitive drum 10 rather than only having the linear tip of the first contact portion 264*c*1 to be in contact with the photosensitive drum 10, it is possible to bias stably the seal member 264 via a bias mechanism 265 (to be described later) towards the photosensitive drum 10. When there is one contact portion 264*c*, because the linear tip is used to contact with the photosensitive drum 10, it will be difficult to form a stable contact due to a loss in balance. In addition, an M letter shape is formed by the portion (contact portion 264*c*) of the contact portion 264*a* in contact with the photosensitive drum 10, the portion in contact with the cleaning blade 262, and the portion in contact with the frame 263. A valley 264*d* is formed between the two contact portions 264*c*. In addition, a groove 264*e* is formed to extend in the rotation direction of the photosensitive drum 10 on the surface of the contact portion 264*a* which is not facing to the photosensitive drum 10 in the vicinity of the frame 263. With this valley 264*e*, the elastic deformation of the contact portion 264*a* in the axis direction of photosensitive drum 10 becomes easy. In addition, two side surfaces of the contact portion 264*a* are in surface contact with the frame 263 and the cleaning blade 262. More specifically, a first side surface 264*x* in the vicinity of the valley 264*e* is in contact with the frame 263, and a second side surface 264*y* is the side surface of the opposite side of the first side surface 264*x* and the second side surface 264*y* and the cleaning blade 262 are in contact with each other. In addition, the surface of the contact portion 264*a* on the side opposite the photosensitive drum 10 has a coating by a fluorine system.

The movement control portion 264*b* is integrally formed with the contact portion 264*a*, and extends in the direction perpendicular to the direction in which the photosensitive drum 10 extends, i.e., perpendicular to the axis of rotation of the photosensitive drum 10. In addition, the movement control portion 264*b*, as shown in FIGS. 3 and 4, includes a protrusion 264*f* is formed in the end portion of the surface of the movement control portion 264*b* on the opposite side of the photosensitive drum 10, and is supported by the concave portion 263*a* in circular form of the frame 263. More specifically, the inner diameter of the concave portion 263*a* in circular form of the frame 263 is greater than the outer diameter of the protrusion 264*f*, and the protrusion 264*f* is inserted into the circular concave portion 263*a*. As a result, the seal member 264 is able to move only in a predetermined area, and the movement thereof is controlled.

The bias mechanism 265 is configured to bias the contact portion 264*a* to the side of the photosensitive drum 10, and is made of a support portion 265*a* and an elastic member 265*b*. The support portion 265*a* is in contact with the surface of the contact portion 264*a* which is not facing to the surface of the photosensitive drum 10, and is formed to be circular. The elastic member 265*b* is a helical compression spring that is arranged between the frame 263 and the support portion 265*a*, in an elastically deformed state, and biases the support portion 265*a* to the side of the photosensitive drum 10.

Next, an image forming operation of the wet type color printer 1 will be described.

Referring to FIG. 1, the color printer 1 receives an image formation command from a personal computer (PC) that is connected to the wet type color printer 1, and forms toner images of each color using image forming units FY, FM, FC, and FB, in response to the image data for which the forming command is received. More specifically, an electrostatic latent image is formed based on the image data on the photosensitive drum 10, and toner is supplied from the developing device 14 to the electrostatic latent image. In this manner, each image formed at the image forming unit 2 is first transferred onto the intermediate transfer belt 21, and a color toner image is formed by superimposing the images onto the intermediate transfer belt 21.

In synchronization with the formation of the color toner image, sheets that are stored in the sheet storage unit 3 are taken out one sheet at a time from the sheet storage unit 3 by a sheet feeder not shown in the figures, and conveyed along the sheet conveyance unit 7. Then, the sheet is fed to the second transfer unit 4 in accordance with the timing of the first transfer to the intermediate transfer belt 21, and an operation of a second transfer of the color toner image on the intermediate transfer belt 21 to the sheet is performed by the second transfer unit 4. The sheet with the color toner image transferred thereon is further conveyed to the fixing unit 5, and the color toner image is fixed onto the sheet by heat and pressure. Furthermore, the sheet is then discharged from the exterior of wet type color printer 1 by the discharging unit 6. After the second transfer, developer remaining on the intermediate transfer belt 21 is removed from the intermediate transfer belt 21 by the cleaning unit 22 of the intermediate transfer belt 21.

The operation of cleaning the developer on the photosensitive drum 10 will be described with reference to FIGS. 1 to 6.

Developer not transferred to the intermediate transfer belt 21 on the photosensitive drum 10 is removed. More specifically, the cleaning blade 262 will scrape off developer on the photosensitive drum 10 by sliding against the photosensitive drum 10. Here, the seal member 264 is arranged on two end portions of the cleaning blade 262. As a result, it is possible to prevent developer from leaking from the side of the cleaning blade 262 to the photosensitive drum 10 when the cleaning blade 262 is scraping.

Here, it is possible to prevent developer from leaking from the side of the cleaning blade 262, especially when liquid developer (including toner and carrier) is used. In addition, since the valley 264*d* is formed in the seal member 264, the elastic deformation in the axis direction of the photosensitive drum 10 becomes easy. In addition, since the seal member 264 is biased to the side of the photosensitive drum 10 by the bias mechanism 265, this further makes it difficult for gaps to be formed between the photosensitive drum 10 and the seal member 264. Furthermore, the movement control portion 264*b* is able to control the movement of the seal member 264 along with the rotation of the photosensitive drum 10.

(a) In the above described embodiment the color printer 1 is described. However, the present invention is not limited thereto, and can be applied to a copying machine, a multi-function device, and the like.

(b) In addition, a wet type of developer is used in the above described embodiment. However, the present invention is not limited thereto, and is also effective when a dry type of developer or developer having small particles is used.

(c) Furthermore, in the above described embodiment, the seal member 264 is formed by urethane rubber. However, the present invention is not limited thereto, and polyurethane elastomer, fluoro-rubber, NBR, and the like can be used.

(d) In the present embodiment, the photosensitive drum that is an electrostatic latent image carrier is given as an example of a rotation body. However, the present invention can be applied to an intermediate transfer belt which is a member that holds developer, a developing roller, and furthermore, a carrier remover member in the form of a roller and the like, sheet conveyance member of the image forming device that could be stained by developer, a transfer member, and the like.

(e) In the present embodiment, the insertion hole is a circular concave portion. However, the present invention is not limited thereto. When the leakage of developer is not a concern, it can be a through-hole, a hole (concave portion) that has a shape and a section of a square, and the like.

The term "configured" as used herein to describe a component, section or part of a device includes hardware and/or software that is constructed and/or programmed to carry out the desired function.

Moreover, terms that are expressed as "means-plus function" in the claims should include any structure that can be utilized to carry out the function of that part of the present invention.

GENERAL INTERPRETATION OF TERMS

In understanding the scope of the present invention, the term "configured" as used herein to describe a component, section or part of a device includes hardware and/or software that is constructed and/or programmed to carry out the desired function. In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers, and/or steps. The foregoing also applies to words having similar meanings such as the terms, "including," "having," and their derivatives. Also, the terms "part," "section," "portion," "member," or "element" when used in the singular can have the dual meaning of a single part or a plurality of parts. As used herein to describe the present invention, the following directional terms "forward, rearward, above, downward, vertical, horizontal, below, and transverse" as well as any other similar directional terms refer to those directions of an image forming device equipped with the present invention. Accordingly, these terms, as utilized to describe the present invention should be interpreted relative to an image forming device equipped with the present invention as normally used. Finally, terms of degree such as "substantially," "about," and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A leakage prevention member configured to prevent leakage of developer from a side of a cleaning member arranged on a cleaning device configured to clean a rotation body when cleaning a surface of the rotation body of an image forming device, the leakage prevention member comprising:

a contact portion having an elastic member impermeable to developer, the contact portion being configured to contact the surface of the rotation body to prevent developer from passing between the surface of the rotation body and the contact portion; and a movement control portion being connected to the contact portion and configured to control the movement of the contact portion while contacting the rotation body.

2. A leakage prevention member configured to prevent leakage of developer from a side of a cleaning member arranged on a cleaning device configured to clean a rotation body when cleaning a surface of the rotation body of an image forming device, the leakage prevention member comprising:

a contact portion having an elastic member and a first contact portion being in line contact along the surface of the rotation body to prevent developer from passing between the surface of the rotation body and the contact portion; and a movement control portion being connected to the contact portion and configured to control movement of the contact portion while contacting the rotation body.

3. The leakage prevention member according to claim 2, wherein the contact portion further includes a second contact portion, the second contact portion configured to be in line contact along the surface of the rotation body along an area extending perpendicularly to a rotation axis of the rotation body and arranged to be parallel with the first contact portion on an outer side in the rotation axis direction of the rotation body seen from the center of the rotation axis of the rotation body.

4. The leakage prevention member according to claim 2, wherein the movement control portion is integrally formed with the contact portion.

5. The leakage prevention member according to claim 4, wherein the movement control portion controls the movement of the contact portion with the rotation of the rotation body.

6. The leakage prevention member according to claim 5, wherein the movement control portion has an engagement member configured to engage with a frame of a cleaning device.

7. The leakage prevention member according to claim 6, wherein the engagement member of the movement control portion is a protrusion that engages with an insertion hole that is formed in the frame of the cleaning device.

8. The leakage prevention member according to claim 7, wherein the insertion hole is a cavity in a circular form, and the protrusion is a cylindrical portion having a radius that is smaller than the insertion hole.

9. The leakage prevention member according to claim 5, wherein at least the contact portion is coated by a fluorine system.

10. The leakage prevention member according to claim 5, wherein the contact portion and the movement control portion are a cast.

11. The leakage prevention member according to claim 2, wherein the contact portion surface on a side of the rotation body has the same curvature as the rotation body.

12. The leakage prevention member according to claim 2, wherein a valley is formed between the first contact portion and a second contact portion in the contact portion and extends in a direction that intersects with the axis direction of the rotation body, a groove is formed on a surface on the opposite side of the surface that is configured to contact the surface of the rotation body, and the contact portion is configured to be deformed elastically in the axis direction of the rotation body.

13. A cleaning device configured to clean the surface of a rotation body of an image forming device, the cleaning device comprising:

a frame being arranged in the vicinity of the rotation body;

a plate shaped blade member extending in a direction substantially parallel to an axis of rotation of the rotation body, being arranged in the frame with a front edge thereof contacting the surface of the rotation body; and leakage prevention members being arranged on opposite sides of the blade member, each leakage prevention member having a contact portion having an elastic member and a first contact portion being in line contact along the surface of the rotation body to prevent developer from passing between the surface of the rotation body and the contact portion, and a movement control portion being connected to the contact portion and configured to control movement of the contact portion while contacting the rotation body.

14. The cleaning device according to claim 13, wherein the leakage prevention member is arranged between the blade member and the frame in an elastically deformed state, and in surface contact with the blade member and the frame.

15. The cleaning device according to claim 13, further comprising a bias mechanism configured to bias the leakage prevention member to the side of the rotation body.

16. A cleaning device configured to clean the surface of a rotation body of an image forming device, the cleaning device comprising:

a frame being arranged in the vicinity of the rotation body;

a plate shaped blade member extending in a direction perpendicular to an axis of rotation of the rotation body, and being fixed to the frame with a front edge thereof being configured to contact a surface of the rotation body; and leakage prevention members being arranged on opposite sides of the blade member, each leakage prevention member having a contact portion having an elastic member and a first contact portion being in line contact along the surface of the rotation body to prevent developer from passing between the surface of the rotation body and the contact portion, and a movement control portion being connected to the contact portion and configured to control movement of the contact portion while contacting the rotation body, the movement control portion being integrally formed with the contact portion, and the contact portion controls the movement with the rotation of the rotation body.

* * * * *